United States Patent [19]

Delluc

[11] Patent Number: 4,495,977

[45] Date of Patent: Jan. 29, 1985

[54] WIND-UP THERMAL INSULATING AWNING

[76] Inventor: René E. Delluc, 2, Square du Berry, 91300 Massy, France

[21] Appl. No.: 398,147

[22] Filed: Jul. 14, 1982

[30] Foreign Application Priority Data

Sep. 21, 1981 [FR] France ..... 81 17760

[51] Int. Cl.[3] ..... E04F 10/06

[52] U.S. Cl. ..... 160/70; 160/22; 160/66

[58] Field of Search ..... 160/22, 66, 70; 428/246, 316.6, 319.1

[56] References Cited

U.S. PATENT DOCUMENTS 2,695,663 11/1954 D'Azzo ..... 160/22

4,188,445 2/1980 Hill ..... 428/246

4,210,070 7/1980 Tatum et al. ..... 428/246

4,254,179 3/1981 Carson et al. ..... 428/316.6

*Primary Examiner*—Peter M. Caun

*Attorney, Agent, or Firm*—Sughrue, Mion, Zinn, Macpeak and Seas

[57] ABSTRACT

An exterior wind-up awning having a high degree of thermal insulation to provide a cool shaded area comprises a flexible insulating sheet 3 of alveolate material such as plastic foam attached to a canvas sheet 1. A plastic film 2 is glued between the canvas and the foam sheet. Mating or nesting spacer bead strips 5, 6 are provided along the length of the awning on opposite sides of the canvas, flanking the foam sheets, to prevent their destructive compression during roll-up.

5 Claims, 6 Drawing Figures

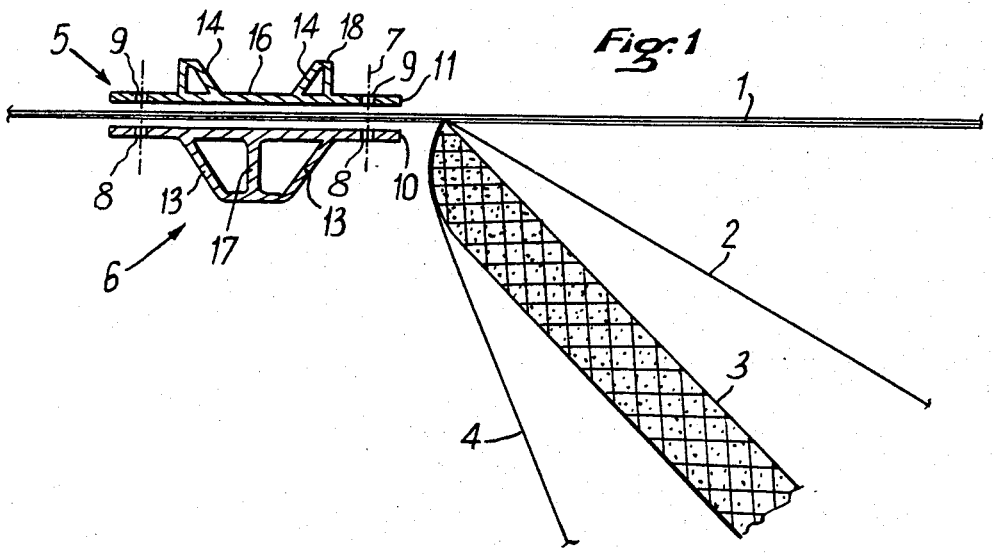
Fig. 1
Fig. 3
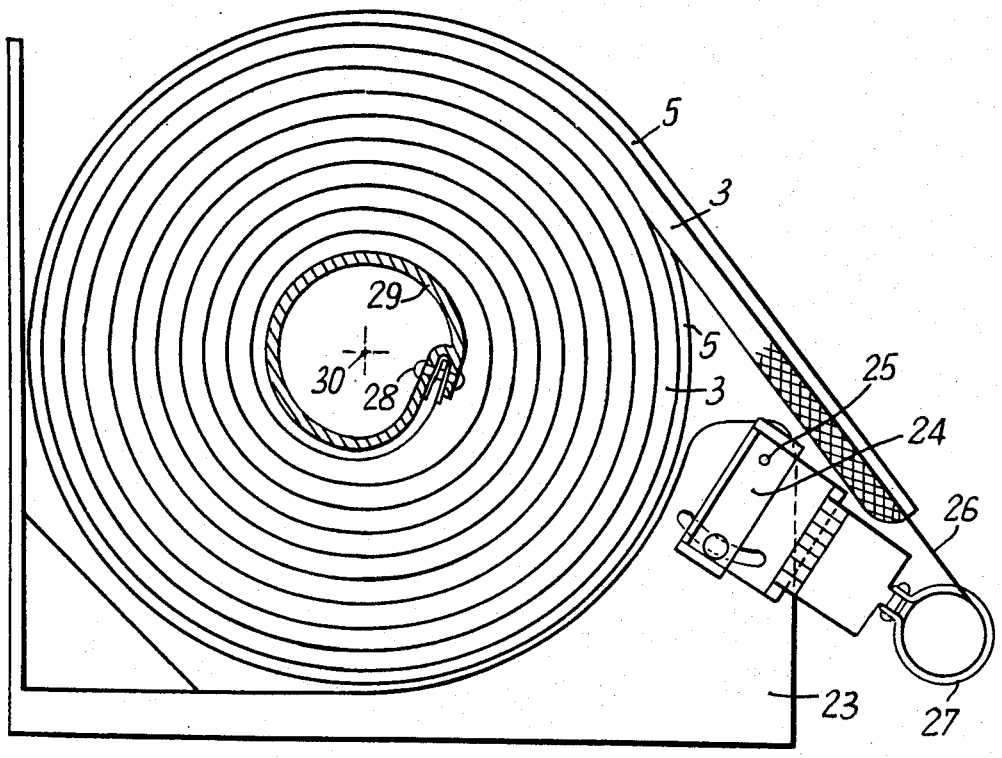

WIND-UP THERMAL INSULATING AWNING

This invention relates to a wind-up awning or blind having a very high thermal insulating power, which may be used as an external awning to provide a shaded area. It comprises at least one layer of heat-insulating alveolate material such as plastic foam.

BACKGROUND OF THE INVENTION

Conventional awnings are usually made of canvas having a thick texture, which may be unwound from a roll and extended by mechanical means such as lateral swivel arms. Winding back such awnings presents no special problems, as the required force depends essentially upon the dimensions of the awning and of the devices provided for holding the lower free edge of the awning at some distance from the vertical plane of the wind-up roll axis.

These conventional awnings have a rather low heat-insulating power, which is supplied only by the thickness of the fabric. Even when using thick canvas, the temperature difference between air outside of the shaded area provided by the awning and air under the awning remains quite small, and the shadow cast by the awning does not lower the temperature as much as might be expected. This effect is usually a combined result of the high temperature of ambient air and of the very substantial heat transfer across the textile fabric. In fact, in the absence of air circulation, particularly with awnings having lateral trimmings such as hooded awnings some very hot air will accumulate directly under the awning, so that instead of feeling cool under the shade of the awning an unpleasant hot feeling is experienced similar to being in a hothouse. This effect is even observed at times of intense sunshine when there is some air circulation and when the awning has no side trimmings. The thickness of the hot air layer will then be reduced, but since the thermal radiation under the awning remains quite strong, the effectiveness of the awning is not satisfactory.

SUMMARY OF THE INVENTION

The object of this invention is to obviate the drawbacks of awnings of the above-described type, by providing a flexible screen for blocking off solar thermal radiations, this screen being made of an alveolate material such as plastic foam and being adapted to be rolled up when not in use. The screen is provided with at least one elongated flexible spacer bead having sufficient thickness to keep apart successive overlapping layers of the flexible screen as they are rolled up, thereby preventing the soft alveolate material from being compressed.

Whereas any type of plastic foam mat may be used, flexible plastic foam sheets of polyurethane or polypropylene are preferred since these foams present excellent characteristics when used with a thickness of about 1 cm at usual temperatures during extended periods of intense sunshine.

Another feature of the invention consists in reinforcing these plastic sheets by binding them to a sheet of canvas, to which the flexible spacer beads are also attached, each plastic sheet extending between two spacers and being joined to the canvas by an impervious plastic film.

These plastic foam sheets are thus protected against water absorption, either condensed moisture or rain water impregnating the canvas. This is advantageous, even when the foam sheet is provided with a thin impervious skin sealing all the open or closed cells of the foam, as the plastic film will make up for any deficiencies in the imperviousness of the skin while providing an easy means for assembling the foam sheet with the canvas by gluing.

A further feature of the invention consists in providing two sets of mating spacer beads on opposite sides of the canvas so that one of them will serve as a guide for the other to facilitate rolling up the awning.

Preferably, the flexible spacer beads will comprise a flexible strip forming the base of a V-shaped channel, the wings of which present notches along their length so that they may readily be wound up around a roll having a very small radius.

BRIEF DESCRIPTION OF THE DRAWINGS

In the drawings:

FIG. 1 shows an exploded cross-section of an awning according to the invention, along a plane to the winding axis, FIG. 3 is a diagrammatic transverse section of a wound-up awning with a console carrying extension arms.

DETAILED DESCRIPTION OF THE PREFERRED EMBODIMENTS

Figure 2:
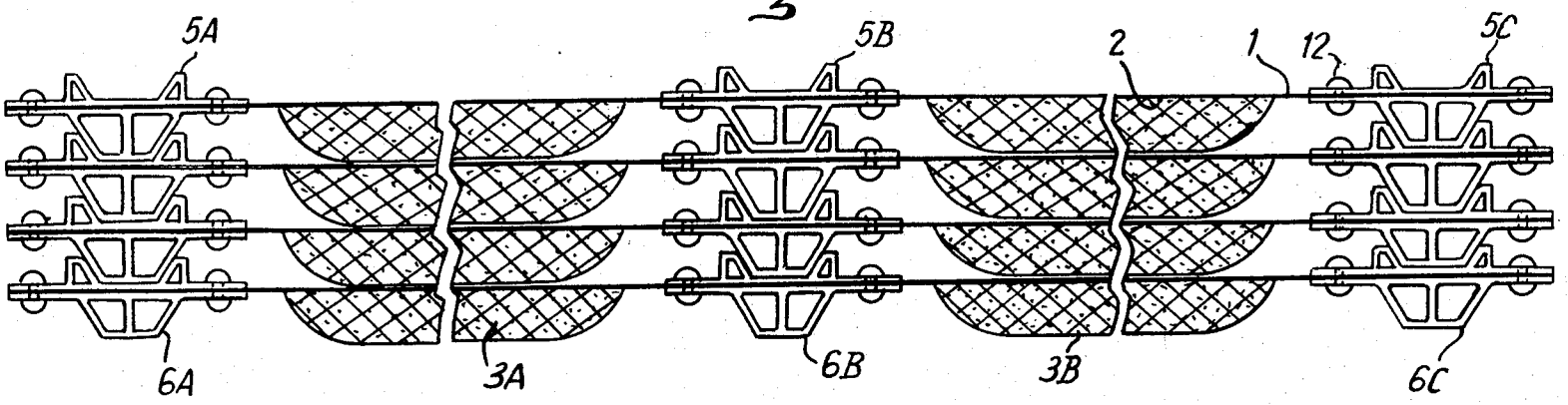
FIG. 2 shows a partial cross-section of a wound-up awning, along a plane parallel to the winding axis.

Referring to FIG. 1, the awning comprises a canvas sheet 1 to which is glued an impervious plastic sheet 2, the underside of which is glued to a sheet of plastic foam 3 having a high thermal insulation power. The underside of this alveolate foam sheet 3 is preferably covered by a thin sheet 4 of decorative material. Either or both sheets 2 and 4 may be provided with a heat-reflecting metal coating to enhance the heat-insulating effect of the plastic foam sheet 3. Spacer beads or strips 5 and 6 are provided on the opposite faces of the canvas sheet 1, the bead 5 on the upper side of the canvas having a V-shaped profile and the bead 6 on the underside having an inverted V profile complementary to and mating with the profile of bead 5.

Whereas the spacer beads 5 and 6 could be affixed to the plastic sheet 3 by any suitable means, they are preferably linked to the sheet through the intermediary of the canvas sheet.

Depending upon the width of the awning, the stength of the canvas and the strength of the foam sheet 3, it may be possible to provide a single spacer bead strip down the middle of the awning, with two foam sheets on either side of this strip. With a medium width awning spacer strips will be required along both edges of the canvas 1, and with a very wide awning several sets of spacer strips will be required at intervals along the width of the canvas.

FIG. 2 shows an example in which three sets of spacer beads are provided, namely beads 5A, 5B and 5C on the upper face of the canvas and beads 6A, 6B and 6C on the underside, with foam sheets 3A and 3B respectively positioned between adjacent sets of spacer beads.

FIG. 2 further shows how spacer beads 5 nest in the V-shaped grooves of beads 6 to maintain the proper alignment of the successive windings of the awning during roll-up. This avoids any risk of lateral shift when winding up the awning, and thus prevents any compression of the plastic foam 3.

In fact, some plastic foams are rather fragile and are liable to lose some of their initial resiliency after they have been compressed which may affect their heat-insulating capacity. The guiding function of the strips 5 and 6 thus plays a very important role in preventing any compression of the foam sheets.

Referring again to FIG. 1, the spacer beads 5 and 6 have flat and flexible lateral extensions 10 and 11 which are provided, along axis 7, with holes 8 and 9 through which rivets 12 are inserted (FIG. 2) to tightly clamp the canvas between upper beads 5 and lower beads 6. When the awning is being wound up, the inclined edges 13 of the lower bead 6 slide along the corresponding edges 14 of the upper bead 5 until the flat bottom of bead 6 abuts agaisnt the flat base 16 of bead 5. The canvas is thus continuously stretched from edge to edge between two paris of complementary spacer beads, while there is always maintained, between successive turns of the wound-up canvas, a spacing which slightly exceeds the thickness of the plastic foam sheet 3 to thus avoid any compression thereof. Any self-compression of the foam after roll-up is further avoided by its inherent lightness.

Figure 4:
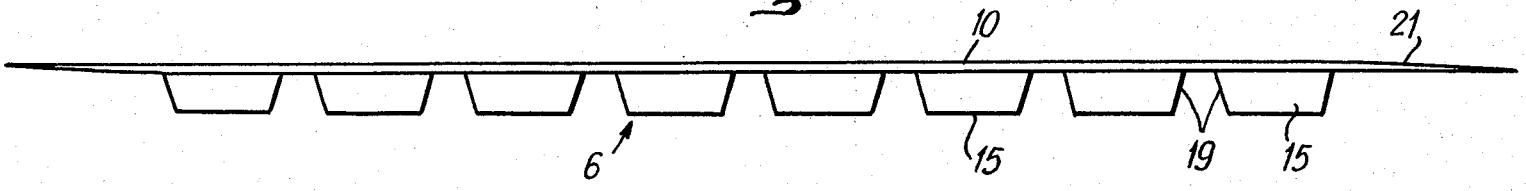
FIG. 4 is a longitudinal view of a spacer bead affixed to the underside of the canvas.
Figure 5:
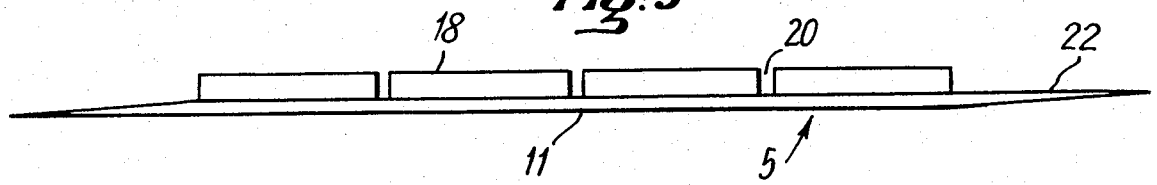
FIG. 5 is a longitudinal view of a spacer bead affixed to the upper face of the canvas.

FIGS. 4 and 5 respectively show longitudinal views of spacer beads 6 and 5. Which comprise a flexible flat base 10, 11 and rigid wings 15, 18 (refer also to FIG. 1). To allow the spacer bead strips to bend during roll-up, their rigid wings 15, 18 are crenellated. Thus rigid wing 15 of the male (lower) spacer bead 6 is divided into relatively short segments with inclined edges 19 allowing the bead to be bent over a short radius. The upper (female) spacer bead 5 is similarly divided into segments which may however be somewhat longer. The segments are separated by simple straight notches 20, which spread apart when the awning is wound up. Spacer beads 5 and 6 are preferably moulded in elements of various dimensions. According to the length of an awning, several elements may be joined together end-to-end to form a spacer bead strip of suitable length. This is facilitated by providing tapered ends 21, 22 on the flexible base 10, 11 of each element so that they can be assembled with lap joints. According to the type of material used, the male spacer bead 6 may be provided with a longitudinal stiffener web 17 (FIG. 1).

Since the spacing between two adjacent layers of wound-up canvas will always exceed the thickness of the plastic foam layers 3, it is not strictly necessary to coat the underside of the foam, opposite the canvas 1, with a plastic film such as the film 2 on the upperside of the foam. It will thus be possible to glue a simple sheet of ornamental fabric 4 directly to the foam. Various kinds of glue may be used, as long as they are compatible with the materials which are to be assembled. For instance, plastic film 2 may be made of polypropylene and it may be glued with an acrylic adhesive having a good heat resistance. Alternatively, polyurethane adhesives are also suitable. Within the scope of the invention, it is also possible to assemble the spacer strips to the canvas by gluing or stitching.

By way of example, an awning according to the invention having a length of 3 meters with a foam layer approximately 1 centimeter thick may be wound up with a diameter of approximately 24 cm.

Figure 6:
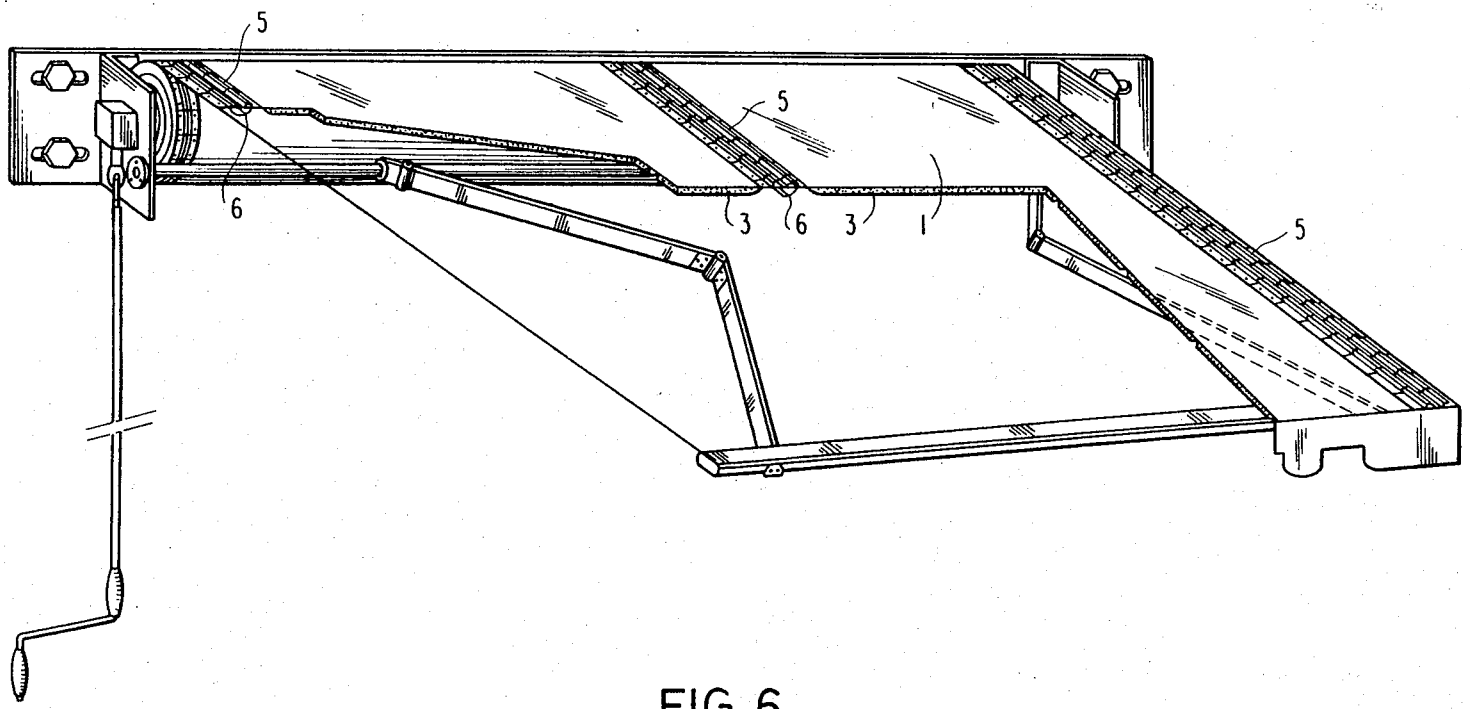
FIG. 6 is a perspective view, in partial cutaway, of an awning according to the invention in a partially extended position.

FIG. 3 shows a winding console 23 carrying an adjustable extension arm 24 swivelling about an axis 25 to allow the unwound portion of the awning to be extended in a more or less inclined position. The lower edge 26 of the canvas is provided with a guide member 27 of any appropriate design. Only the outer spacer bead 5 is visible in this FIG., but it will readily be understood that this bead cooperates with the underside spacer bead 6. The upper end of the awning is attached, for instance by rivets 28 to a wind-up roll 29 rotating about an axis 30. The spacer bead strips extend along the full length of the foam layer 3 on the canvas. A perspective view of the partially extented or partially wound awning is shown in FIG. 6.

The underside liner sheet 4 may be attached along its edges to the canvas 1 by sewing or any other means, including the rivets 12, so as to form a sheath into which the foam sheet 3 may be slipped, such foam sheet being then preferably coated with a plastic sheet 2 on both faces. The sheet 2 may also be glued to the canvas 1 without being glued to the foam sheet, to thus provide an awning in which the insulating foam sheet is removable.

What is claimed is:

1. A thermally insulating exterior awning adapted to be wound up into an elongate roll, comprising:

(a) a sheet of canvas (1) having one edge adapted to be secured to a winding roll, (b) a plurality of elongate, flexible spacer bead strips (5, 6) attached to the canvas sheet perpendicular to said one edge and spaced apart from each other, and (c) a thermally insulating foam plastic sheet (3) attached to an underside of the canvas sheet between adjacent spacer bead strips, (d) wherein the height of the spacer bead strips is greater than the thickness of the foam plastic sheet to thereby maintain a sufficient spacing between adjacent layers of the canvas sheet upon wind-up to prevent the destructive compression of the foam plastic sheet.

2. An awning according to claim 1, further comprising a fluid impervious plastic film (2) sandwiched between the canvas and foam plastic sheets.

3. An awning according to claim 1, wherein each spacer bead strip comprises a first strip member (5) attached to an upper surface of the canvas sheet and a second, complementarily configured second strip member (6) attached to a lower, undersurface of the canvas sheet opposite the first strip member, whereby said first and second strip members matingly nest upon wind-up.

4. An awning according to claim 3, wherein the first strip member defines, in cross-section, a V-shaped notch having a flat bottom, and the second strip member defines, in cross-section, a V-shaped projection having a flat bottom.

5. An awning according to claims 3 or 4, wherein the first and second strip members are laterally crenellated to enable the wind-up thereof with the awning.

* * * * *